US012084927B2

(12) United States Patent
Saunders et al.

(10) Patent No.: US 12,084,927 B2
(45) Date of Patent: Sep. 10, 2024

(54) CONFIGURABLE DRILL FLUID CONTAINMENT DEVICE

(71) Applicant: NATIONAL OILWELL VARCO, L.P., Houston, TX (US)

(72) Inventors: Christopher J. Saunders, Conroe, TX (US); Justin Benjamin Kinney, Katy, TX (US); Roy George Eid, League City, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 38 days.

(21) Appl. No.: 17/929,866

(22) Filed: Sep. 6, 2022

(65) Prior Publication Data

US 2023/0340842 A1 Oct. 26, 2023

Related U.S. Application Data

(60) Provisional application No. 63/334,002, filed on Apr. 22, 2022.

(51) Int. Cl.
*E21B 21/01* (2006.01)

(52) U.S. Cl.
CPC ..... *E21B 21/019* (2020.05)

(58) Field of Classification Search
CPC ..... E21B 21/019; E21B 21/00; E21B 21/01; E21B 21/015
See application file for complete search history.

(56) References Cited

U.S. PATENT DOCUMENTS

| | | | | |
|---|---|---|---|---|
| 2,068,665 | A * | 1/1937 | Douglass | E21B 21/01 277/322 |
| 2,214,428 | A * | 9/1940 | Miller | E21B 21/01 166/81.1 |
| 2,505,282 | A * | 4/1950 | Endsley | E21B 17/006 166/81.1 |
| 4,872,508 | A * | 10/1989 | Gordon | F16J 15/004 166/96.1 |
| 9,605,500 | B2 * | 3/2017 | Yajure | E21B 21/106 |
| 9,664,002 | B2 | 5/2017 | Webb | |
| 9,689,217 | B2 * | 6/2017 | Holtby | E21B 19/16 |

(Continued)

FOREIGN PATENT DOCUMENTS

| | | |
|---|---|---|
| WO | 2004048746 | 6/2004 |
| WO | 2009049006 | 4/2009 |
| WO | 2020222860 | 11/2020 |

OTHER PUBLICATIONS

"International Application Serial No. PCT US2019 049152, International Search Report mailed Jan. 10, 2020", 4 pgs.

(Continued)

*Primary Examiner* — Shane Bomar
(74) *Attorney, Agent, or Firm* — Schwegman Lundberg & Woessner, P.A.

(57) ABSTRACT

Various embodiments disclosed relate to a configurable drill fluid containment device. The present disclosure includes a device including a central shell configured to at least partially enclose an end of a drill pipe. The central shell can have two halves, each of the halves having flanges that are configured to attaching one or more extension features to the device. The flanges can be configured to attach extension features at an upper end of the device, a lower end of the device, or both.

20 Claims, 9 Drawing Sheets

(56) References Cited

U.S. PATENT DOCUMENTS

| | | | | |
|---|---|---|---|---|
| 9,982,497 | B2 | 5/2018 | Foley | |
| 10,927,619 | B1 * | 2/2021 | Anthony | E21B 19/16 |
| 2003/0146219 | A1 | 8/2003 | Ross | |
| 2005/0205303 | A1 | 9/2005 | Pearson | |
| 2011/0265992 | A1 | 11/2011 | Pearson | |
| 2015/0013994 | A1 * | 1/2015 | Bailey | E21B 21/01 166/384 |

OTHER PUBLICATIONS

"International Application Serial No. PCT US2019 049152, Written Opinion mailed Jan. 10, 2020", 5 pgs.
"International Application Serial No. PCT US2019 049152, International Preliminary Report on Patentability mailed Nov. 11, 2021", 11 pgs.
"Saudi Arabian Application Serial No. 123446970, Office Action mailed Sep. 10, 2023", W English Translation, 3 pgs.
"United Kingdom Application Serial No. 2305706.0, Combined Search and Examination Report mailed Sep. 27, 2023", 5 pgs.
"United Kingdom Application Serial No. 2305706.0, Subsequent Examination Report under Section 18 (3) mailed Feb. 16, 2024", 3 pgs.
"United Kingdom Application Serial No. 2305706.0, Response filed Dec. 21, 2023 to Combined Search and Examination Report mailed Sep. 27, 2023", 11 pgs.
"United Kingdom Application Serial No. 2305706.0, Response filed Apr. 12, 2024 to Subsequent Examination Report under Section 18 (3) mailed Feb. 16, 2024", 12 pgs.

* cited by examiner

CONFIGURABLE DRILL FLUID CONTAINMENT DEVICE

CROSS-REFERENCE TO RELATED APPLICATION

This patent application claims the benefit of U.S. Provisional Patent Application No. 63/334,002, filed Apr. 22, 2022, which is incorporated by reference herein in its entirety.

TECHNOLOGICAL FIELD

The present application relates to systems and device for capturing drilling fluid. More particularly, the present application relates to a containment device for capturing drilling fluid during drill pipe tripping operations.

BACKGROUND

The background description provided herein is intended to generally present the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A drill string used to drill a well may include a drill head on a leading end, drill collar extending upward from the drill head, and a drill pipe extending upward from the drill collar to the drill rig. Drilling operations commonly involve supplying pressurized drill fluid through the drill pipe and drill collar to the drill head. From time to time, drill strings being used to drill wells may need to be removed from the well for one or more reasons such as, for example, servicing the drilling head. Removing a drill string from a well is often referred to as a tripping out. During this process, the pipe string is lifted out of the well in lengths ranging from 30 to 90 feet, for example. That is, sections of drill pipe are commonly 20-30 feet long and depending on the height of the drill rig, one, two, or three sections of drill pipe may be pulled from the well at a given time. In many cases, the drill string will be pulled upward and out of the well by a distance approximately equal to three sections of drill pipe. The three exposed sections may be removed from the drill string as a pipe stand and stored in a pipe rack and the process may be repeated until all, or a majority, of the pipe string is removed from the well or until the drill head is reached, for example.

As may be appreciated and as the drill string is pulled upward, the drill fluid remains in the drill string. When pipe stands are disconnected from the top of the drill string, the fluid in the removed pipe stand flows downward and outward from the pipe stand due to gravity. Capturing the flowing drill fluid for reuse may be performed using a mud bucket. Mud buckets may include a sort of catch basin adapted for positioning around the pipe joint to be disconnected such that when the pipe stand is removed the mud bucket is in position around the pipe joint and captures the drilling fluid which is exiting the pipe stand in any and/or all directions.

For various reason, known mud buckets may be quite large. For example, mud buckets may commonly be sized to seal against the outside of the pipe wall above and/or below the tool joint. Since tool joints vary in length, mud buckets may be oversized to accommodate the variation in tool joint length. Still further, mud buckets may be very large (i.e., sometimes 5 feet tall) due to being designed to contain most, if not all, of the drill fluid from the pipe stand until the fluid can be routed to a drill fluid recycling system. Mud buckets may be mounted on a pedestal at a position for accessing well center.

SUMMARY OF THE DISCLOSURE

The present disclosure provides a configurable fluid containment device, such as a mud bucket, for use with drilling. Containment of drilling "mud" or fluid is important for keeping the drilling floor clean. In some cases, containment of drilling mud can allow for capture and recycle of such fluid.

In general, well drilling pipe is filled with a liquid substance referred to as "mud". This mud can be pumped through the pipe while drilling, such as to aid functions at the bottom hole assembly during operation. As drill string is tripped out of the hole, and connection are broken, mud in the stand is drained. The mud can be captured, as mentioned, and redirected via hose to a remote recovery system, or the mud can be deflected and redirected below the floor.

Typical mud buckets can allow for one of these methods (e.g., capture or deflect), but not both. Additionally, current mud buckets often are of fixed length and size. Such mud buckets are mounted to a rig mounting arm (or other piece of rig equipment), and not easily interchangeable.

Discussed herein is a mud bucket system that allows for effective and quick changing of mud bucket size and type using a modular configuration. Here, the mud bucket can include base components, such as left and right bucket halves, hinge mounts, a frame, seal adapter flanges, hydraulic cylinders, and pipe seal halves. Additional components can be added to the base configuration on the seal adapter flanges and swapped out as desired. For example, mud bucket extensions can be added. Other end effectors, such as pipe wipers, sprayers, or diverters, can also be swapped out.

In an example a configurable drill fluid containment device can include a central shell. The central shell can include a first half shell having a first upper flange and a first lower flange and a second half shell having a second upper flange and a second lower flange. The first half and the second half together can form a jacket configured to at least partially enclose an end of drill pipe. The first upper flange and the second upper flange together can make an upper flange configured for attaching one or more extension features to the device at an upper end. The first lower flange and the second lower flange together can make a lower flange configured for attaching one or more extension features to the device at a lower end.

In an example, a drill rig can include: a support structure; a drill floor situated on the support structure; a mast extending upwards from the drill floor; a drill fluid containment device situated therein, the drill fluid containment device comprising: a central shell having a first half and a second half, the first half shell having a first upper flange and a first lower flange, and the second half shell having a second upper flange and a second lower flange, wherein the first half and the second half together form a jacket configured to at least partially enclose an end of drill pipe; wherein first upper flange and the second upper flange together comprise an upper attachment mechanism configured for connecting one or more extension features to the device at an upper end, and wherein the first lower flange and the second lower flange together comprises a lower attachment mechanism configured for connecting one or more extension features to the device at a lower end.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present disclosure describes, among other things, a drill rig with a drill fluid containment device or mud bucket for capturing drill fluid during tripping operations. The containment device may be a configurable drill fluid containment device or mud bucket. That is, the containment device may have an adjustable length, it may be configured to collect and route drill fluid or configured to deflect the drill fluid but allow it to drop out the bottom of the bucket. The drill fluid containment device may also be configurable to include a wiper mechanism and/or a spray mechanism.

The drill fluid containment device may also be equipped with sensors to identify when the drill fluid has cleared the mud bucket so the bucket may open and allow tripping operations to continue. The present drill fluid containment device may be advantageous by being adjustable in size/length based on changing needs of the tripping operations, changing types of drill fluids, and changes in available systems for wiping the pipe. That is, the tool joint length of the drill string may change depending on the portion of the pipe string that is being tripped or the type of drill pipe being used.

Still further, the need to collect drill fluids may change depending on whether water-based fluids or oil-based fluids are being used. Still further, access to high pressure water to spray or clean drill pipe may or may not be available, so sprayers may work in some circumstances, while in other circumstances, the pipe may be wiped. In some cases both cleaning operations may be performed.

During drilling operations, the drill strings being used to drill wells may need to be removed from the well. During such a removal, the drill string is pulled upwards and the drill fluid remains in the drill string. However, when pipe stands are disconnected from the top of the drill string, the fluid in the removed pipe stand flows downward and outward from the pipe stand. This fluid may be captured by use of a mud bucket. A mud bucket can be, for example, a catch basin, situated and fitted around the pipe joint to capture the fluid which is exiting the pipe stand.

Mud buckets are often sealed around a pipe joint during this process, should be of an appropriate length, and have to be quite large. Mud buckets can be manufactured or sized for use with a specific pipe joint. Discussed here is a configurable mud bucket that can be altered for use with a variety of types of pipe joints, such as with modular add-ons.

Figure 1:
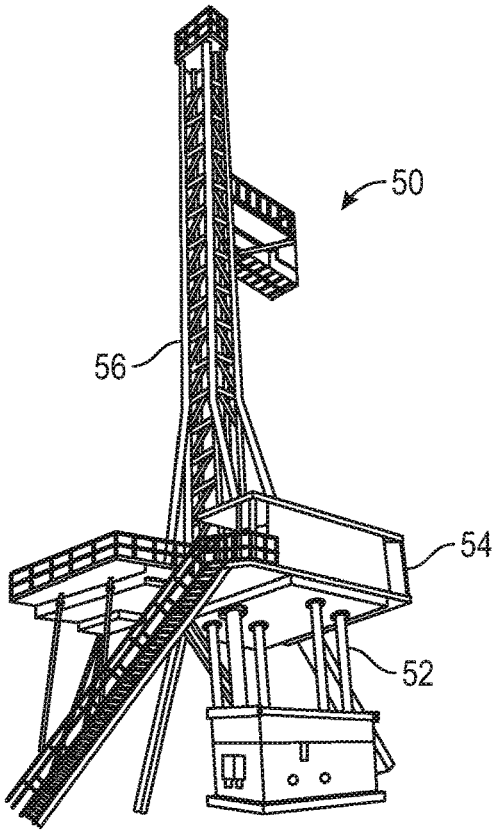
FIG. 1 is a drill rig for well drilling operations, in an example.
Figure 2:
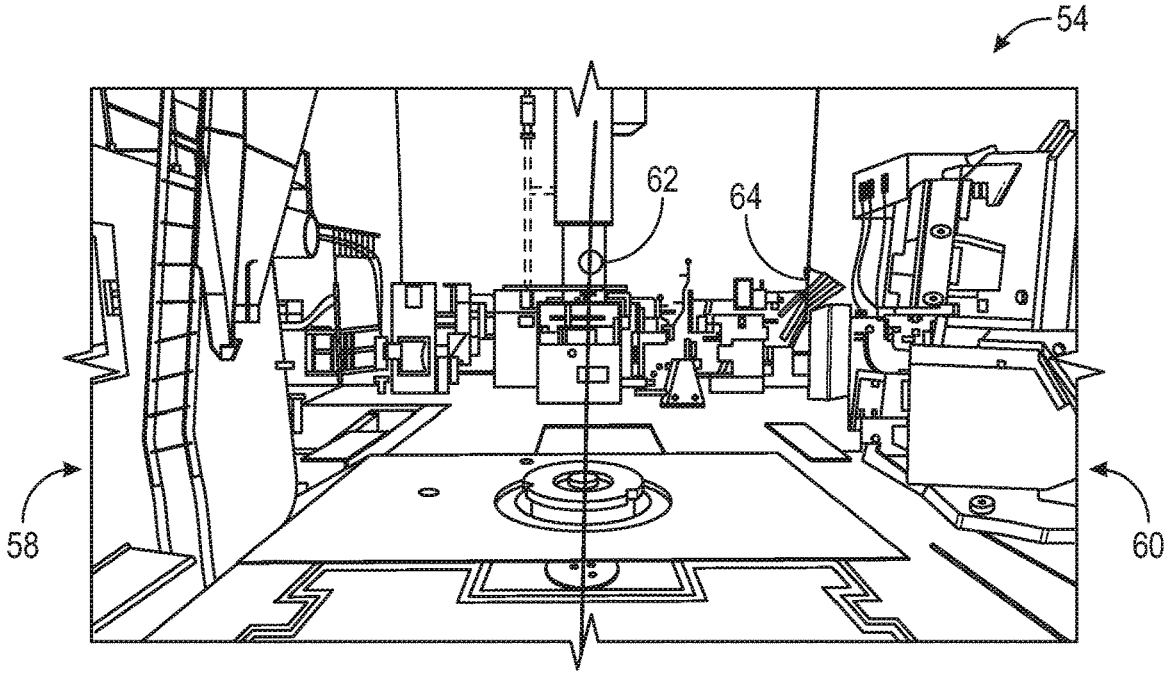
FIG. 2 depicts a drill floor of the drill rig of FIG. 1, in an example.

FIG. 1 shows a drill rig 50 adapted for drilling operations. The drill rig 50 may include a substructure 52 for supporting the drill rig 50, a drill floor 54 where drilling personnel and equipment may be used to perform drilling operations, and a mast 56 for lifting and lowering the drilling string. Other facilities and equipment may include a drill fluid treatment and/or recycling system, drawworks, and other auxiliary equipment and systems. FIG. 2 shows a perspective view of a drill floor 54 of the rig of FIG. 1. The drill floor 54 may include a driller's side 58 and an off-driller's side 60 where each is arranged on opposing sides of well center 62. In FIG. 2, an iron roughneck 64 is shown on the off-driller's side. The iron roughneck 64 may extend laterally outward to well center to connect or disconnect joints of pipe being tripped into or out of a well, respectively. While a land-based rig is shown, offshore drilling ships and other offshore drilling systems may also be provided.

Figure 4:
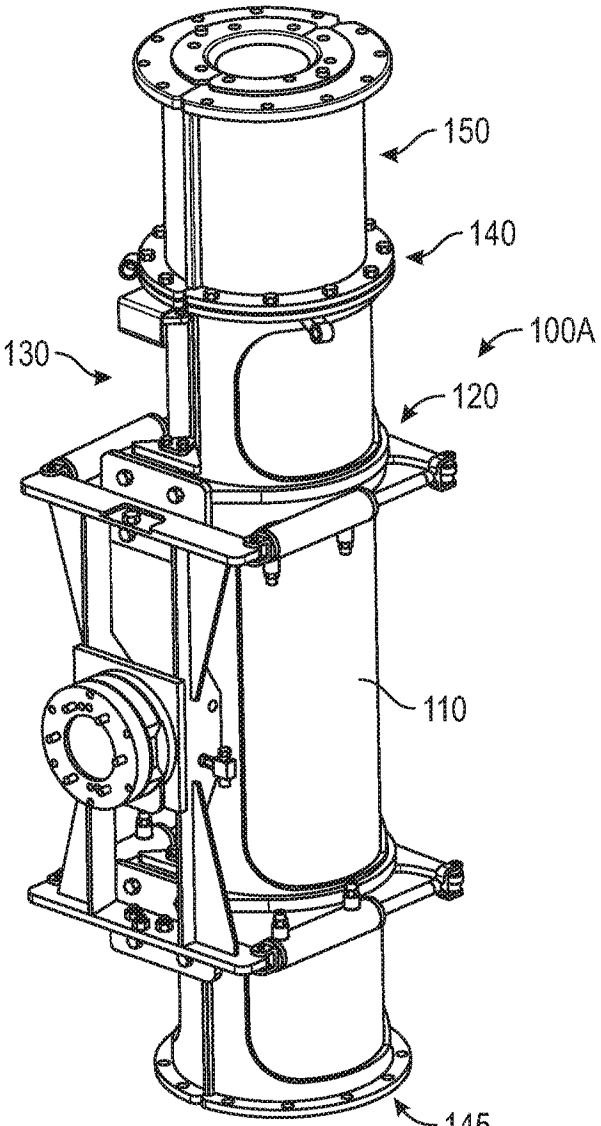
FIG. 4 illustrates a perspective view of the configurable mud bucket of FIG. 3 with an upper extension, in an example.
Figure 3:
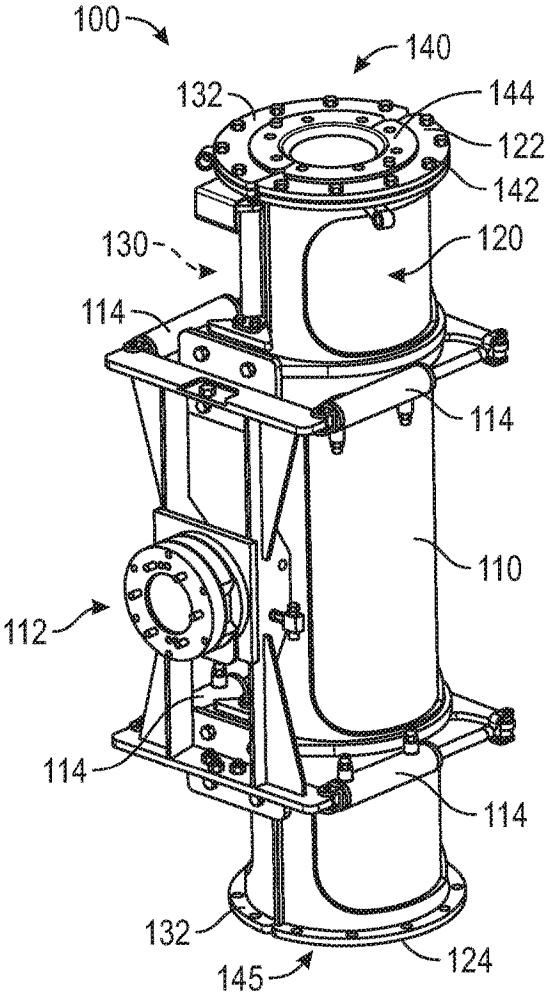
FIG. 3 illustrates a perspective view of a configurable mud bucket in an example.
Figure 5:
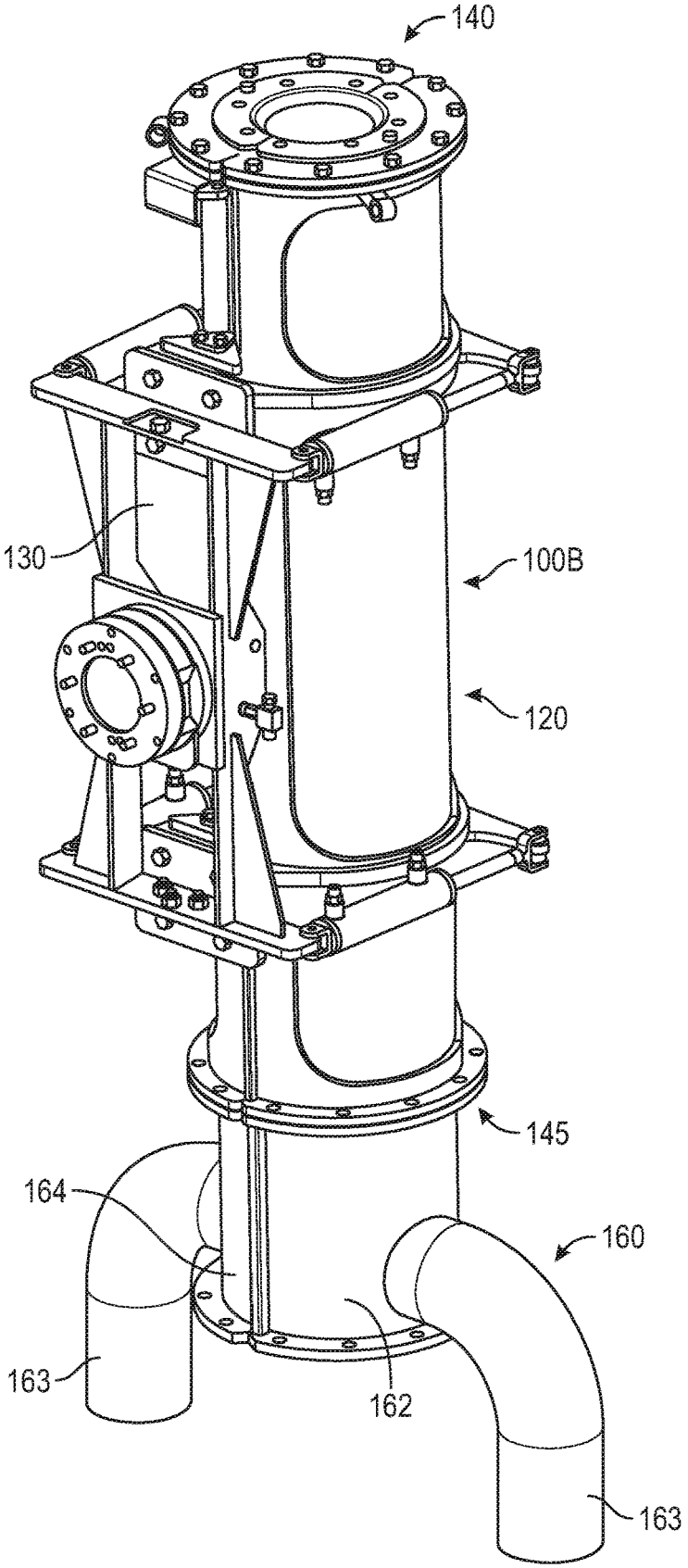
FIG. 5 illustrates a perspective view of the configurable mud bucket of FIG. 3 with a dual outlet fluid diverter, in an example.

FIGS. 3 to 16 depict various views of a configurable drill fluid containment device or mud bucket 100, in various configurations. In FIG. 3, a base version of the mud bucket 100 is depicted. In FIG. 4, a version of the mud bucket 100 with an extension 150 is depicted. In FIG. 5, a version of the mud bucket 100 with a dual fluid outlet diverter 160 is depicted. In FIGS. 6 to 11, a version of the mud bucket 100 with a pipe wiper 170 is depicted. In FIGS. 12 to 16, a version of the mud bucket 100 with a spray assembly 180 is depicted. Any of these variations on the mud bucket 100 can be configured to add or remove various components, such as the extension 150, the dual fluid outlet diverter 160, the pipe wiper 170, and/or the spray assembly 180, to create a desired configuration of the mud bucket 100.

The bucket 100 can include a bracket assembly 112 with hydraulic cylinders 114, a shell 110 with first half 120 and second half 130. The first half 120 can include a first top flange half 122 and a first bottom flange half 124. The second half 130 can include a second top flange half 132 and a second bottom flange half 134. The shell 110 can include a first flange 140 and a second flange 145. The first flange 140 can include a bolt hole pattern 142 and an inner seal 144. The second flange can 145 can include a bolt hole pattern 147 and an inner seal 149.

Depending on the particular configuration, the 100 can optionally include one or more extensions 150, the dual fluid outlet diverter 160 (with a first outlet 162, a second outlet 163, and a central portion 164), the pipe wiper 170, the spray assembly 180, combinations thereof, and other configuration components.

Turning now to FIG. 3, a configurable drill fluid containment device or mud bucket 100 is shown. The configurable mud bucket 100 may include a central shell 110 formed of two halves 120, 130 to form a jacket sized and shaped to enclose a tool joint of a pipe string. In some cases, the jacket can be cylindrical. That is, the two halves 120, 130 of the central shell 110 may each define an inner diameter larger than a pin end or box end of drill pipe so as to able to close around the tool joint and enclose the tool joint.

The shell 110 may include an upper flange 140 and a lower flange 145, each having a bolt hole pattern 142, 147 adapted to receive a seal and/or an extension 150, or another configuration element of the mud bucket (e.g., a dual fluid outlet diverter 160, a pipe wiper 170, a spray assembly 180, or other components).

The first half 120 can include a first top flange half 122 and a first bottom flange half 124, while the second half 130 can include a second top flange half 132 and a second bottom flange half 134. Here the first top flange half 122 and the second top flange half 132 can together make the top flange 140, such as when the two halves 120, 130, are sealed together. The top flange 140 can include the bolt hole pattern 142 and inner seal 144. The bolt hole pattern 142 can, for example, be used to secure an extension onto the central shell 110 at the top end thereof.

Similarly, the first bottom flange half 124, and the second bottom flange half 134, can together make the bottom flange 145. The bottom flange 145 can likewise include a bolt hole pattern 147 and inner seal 149.

In some cases, a different attachment mechanism can be used to allow securement of an extension (or other accessory) to the top flange 140 and/or the bottom flange 145. For example, a snap fit connection, a pneumatic air line connection, a key and lock configuration, or other type of attachment mechanism can be used. The attachment mechanism can be adapted to receive a configuration element for the device.

The inner seals 144, 149 of the respective top and bottom flanges 140, 145, can be used to help fluidly seal one or more attachments to the top and/or bottom of the shell 110. The inner seals 144, 149, can, for example, be situated circumferentially inward from the attachment mechanisms, such as the bolt hole patterns 142, 147.

The flanges 140, 145, can be configured to receive a seal at the bolt hole patterns 142, 147, and the inner seals 144, 149, such as to receive, connect with, and sealably engage one or more extension piece for the mud bucket.

The two halves 120, 130, of the shell 110 may be pivotally connected at a rear side to form a clam shell type mud bucket that may, in an open configuration, approach a drill string from the side and close around the drill string. A seal may be provided along the pivot seam of the two halves of the shell as well as along the edges that come together on the side opposite the pivot seam. As shown, an additional seal may be provided on a top side of the shell and may include two halves of an annular plate that are bolted to the flange of the shell. An inner edge of the annular plate may sized to closely engage the outside surface of the pipe of the drill string. A resilient element may be arranged along the inner edge so as to sealingly engage the drill pipe when the mud bucket is closed around the drill pipe. The device of FIG. 3 may have an open bottom such that mud from the drill sting spills out the bottom of the mud bucket and it acts as more of a deflection shield rather than a container, for example. In one or more examples, a seal may be provided on a bottom side of the shell as well.

The configurable mud bucket may be operable via a bracket assembly 112. The bracket assembly 112 may be configured to open and close the two halves of the shell of the mud bucket. The bracket assembly 112 may include a crossing bar arranged generally perpendicular to the shell across a backside thereof and extending between two outboard ends. The bracket assembly 112 may also include a pair of pivoting ribs extending from a proximal end, along an outer contour of the shell, to a distal end. Each rib of the pair may extend around opposing sides of the shell and may be secured to the outside surface of the shell. The pair of ribs may be pinned to the crossing bar at the proximal end so as to pivot relative to the crossing bar and relative to one another. A grab bar may extend from a distal end of the rib in a somewhat tangential relative to the shell. The grab bar may extend lateral from the shell to a tip that generally aligns with a respective outboard end of the crossing bar. A hydraulic cylinder 114 or other actuator may be arranged between each outboard end of the crossing bar and the tip of the grab bar. As such, activation of the cylinder may cause the rib, and the shell it is attached to, to pivot about the pivot point. In one or more examples, as shown in FIG. 3, an upper bracket assembly and a lower bracket assembly may be provided. In other examples, additional bracket assemblies may be provided.

The configurable mud bucket 100 may also include a handling assembly. That is, as shown in FIG. 3, a handling assembly may be arranged to extend between the upper and lower bracket assemblies so as to allow for the configurable mud bucket to be handled, positioned, or otherwise manipulated and controlled. The handling assembly may include a framework extending between the upper and lower bracket assemblies and an anchor assembly, lifting lug, grasping bar, or other engageable feature arranged on and secured to the framework. While a framework has been described, a plate, bar, or series of plates and bars may be provided for securing the engageable feature. In one or more examples, the engageable feature may include a passive rotation disconnect. That is, for example, the engageable feature may include a connection feature that is passive and may be actuated through motion of a robot end and without the need for hydraulics, pneumatics, motors, and the like. In one or more examples, the passive rotation disconnect may include the one or more described in International Patent Application No.: PCT/US2021/070488, which has been published as WO2021/226622, the content of which is hereby incorporated by reference herein in its entirety.

Turning now to FIG. 4, the configurable mud bucket 100 may include an upper extension 150. As shown, the configurable mud bucket 100 may include any and/or all of the features of the bucket of FIG. 3 but may also include an upper extension 150. The upper extension 150 may be secured to a top end of the mud bucket so as to lengthen the overall length of the mud bucket 100. The upper extension 150 may include two halves similar to the shell of the mud bucket 100 and the two halves may be bolted to respective halves of the shell. As with the shell, a seal may be provided along the pivot seam and along the clam shell seam of the two halves of the extension. As shown, the upper seal may be positioned on the top of the extension rather than on the top of the system shown in FIG. 3. That is, the seal might not be located at the flange of the shell, but may, instead, be positioned on top of the extension portion that has been added.

The extension 150 can, for example, be another length for addition to the top flange 140 or the bottom flange 145. Such an extension 150 can be available to expand the length of the mud bucket 100 and help accommodate longer tool joint configurations. The extension 150 is one example of a type of extension usable with the mud bucket 100. In some cases, an upper bucket extension can be used. In some cases, a lower bucket extension can be used. Upper or lower extensions can, for example, contain two halves, similar to the shell 110. In some cases, accessory assemblies, such as water sprayers, pipe wipers, or other components, can be attached and sealed to the mud bucket 100.

Any of the extensions 150 or other modular components can be configured to fluidly seal with one or more of the top flange 140 or the bottom flange 145, such as through the bolt hole pattern 142 and inner seals 144 or through the bolt hole pattern 147 and inner seals 149. In some cases, extensions (or other connectable accessories) can be configured to allow further addition of extensions thereto. In this case, the extension 150 can contain its own flange assembly with an attachment mechanism and inner seal, similar to top flange 140 or bottom flange 145. In this way, an additional component, such as a second extension, can be added to the extension 150.

FIG. 5 shows the configurable mud bucket 100 of FIG. 3, with a dual outlet diverter assembly 160 arranged on a bottom side thereof. That is, as shown, the bucket may include a bucket assembly similar to the extension 150 described with respect to FIG. 4. However, the diverter 160 may be arranged on a bottom end of the shell elements and each half of the diverter may include an outlet 162, 163 with a pipe or other conduit in fluid communication with the outlet so as to carry fluid away from the mud bucket. In one or more examples, the pipe or other conduit may be arranged over a drain of another pipe such as a flexible pipe may be secured to the diverter pipe. The bottom side of the diverter may include a seal for sealingly engaging against the pipe. That is, a seal such as the one shown and described at the top of FIG. 3 may be provided.

The diverter 160 can be a dual outlet converter with first outlet 162 and second outlet 163. In other examples, a single outlet diverter assembly can be attached. In the example of FIG. 5, the dual fluid outlet diverter 160 is attached at the bottom flange 145 of the mud bucket 100. This can allow for fluid flow away from the mud bucket 100, such as to two different locales. In some cases, the dual fluid outlet diverter 160 can be used to channel mud to a receptacle for capture and recycle.

FIGS. 6-11 show yet another example of the configurable mud bucket including an upper extension and a diverter on a bottom side thereof with a single outlet. The diverter here may be same or similar to the diverter of FIG. 5, except for the single outlet. As shown a wiper mechanism may also be provided. The wiper mechanism may include a hinged hoop structure adapted to move somewhat relative to a longitudinal centerline of the mud bucket. That is, the wiper mechanism may be suspended with cables or struts from the mud bucket so as to be able to move laterally relative to a longitudinal centerline of the mud bucket.

The wiper assembly may include a plurality of radially extending wiper flaps that may overlap in a fashion to maintain wiper contact around the full circumference of the pipe as one or more of the wipers are deflected downward or upward out of plane of the hoop structure.

Figure 7:
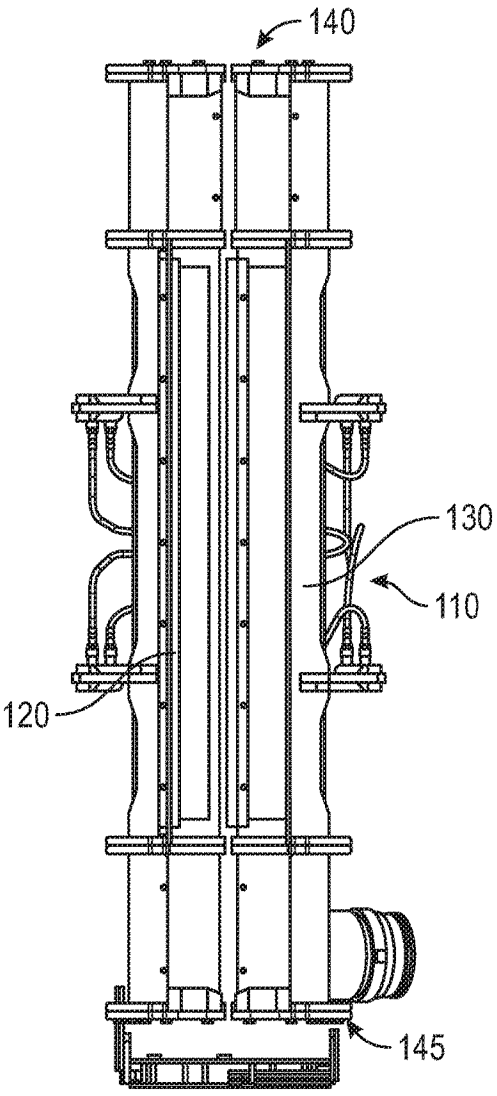
FIG. 7 illustrates a front view of the configurable mud bucket of FIG. 6 in an example.
Figure 6:
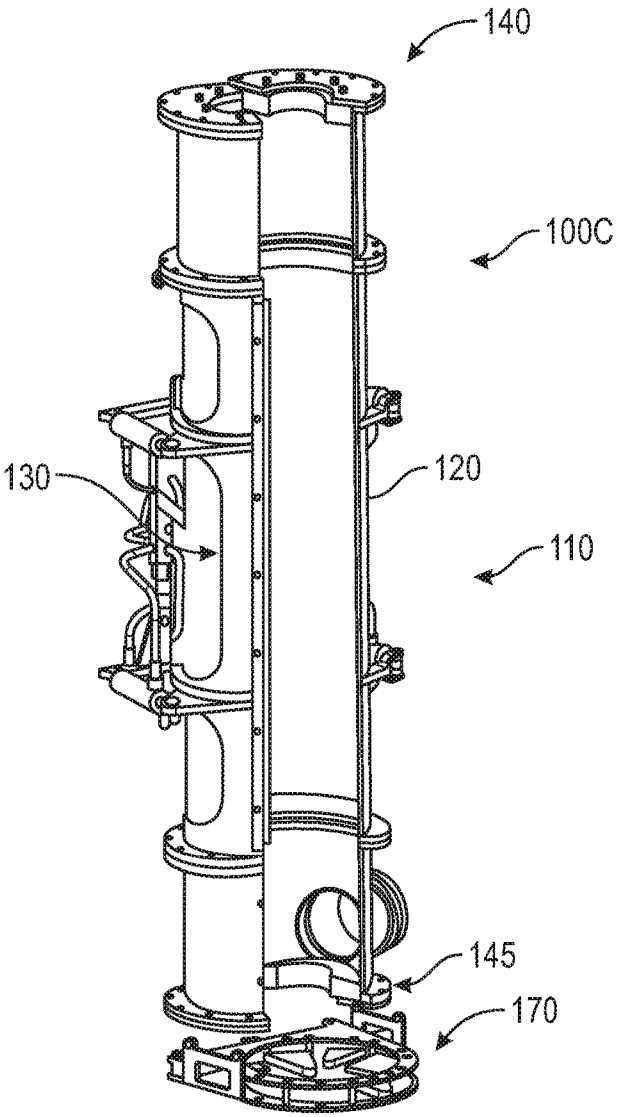
FIG. 6 illustrates a perspective view of the configurable mud bucket of FIG. 4 with a single outlet fluid diverter and a pipe wiper, in an example.
Figure 9:
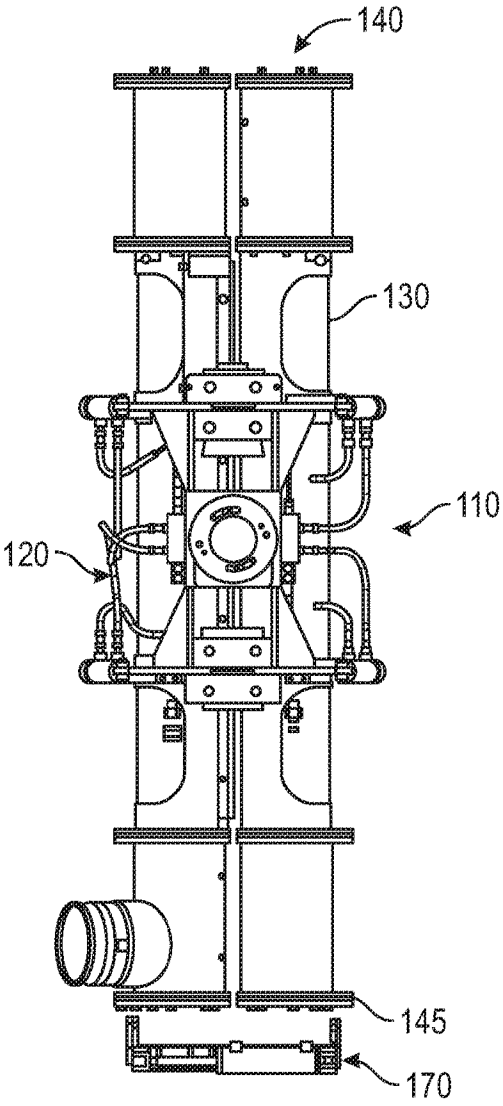
FIG. 9 illustrates a rear view of the configurable mud bucket of FIG. 6 in an example.
Figure 8:
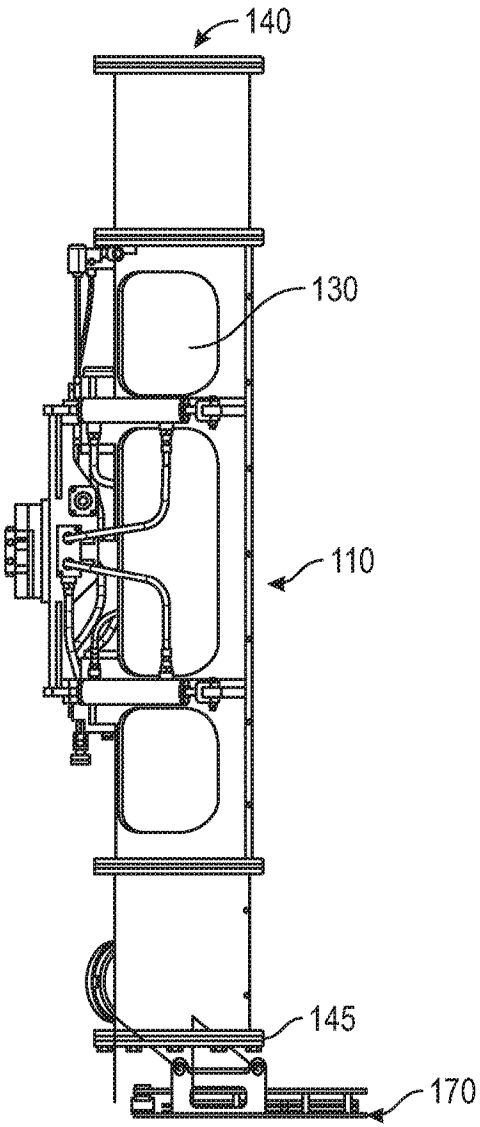
FIG. 8 illustrates a side view of the configurable mud bucket of FIG. 6 in an example.
Figure 11:
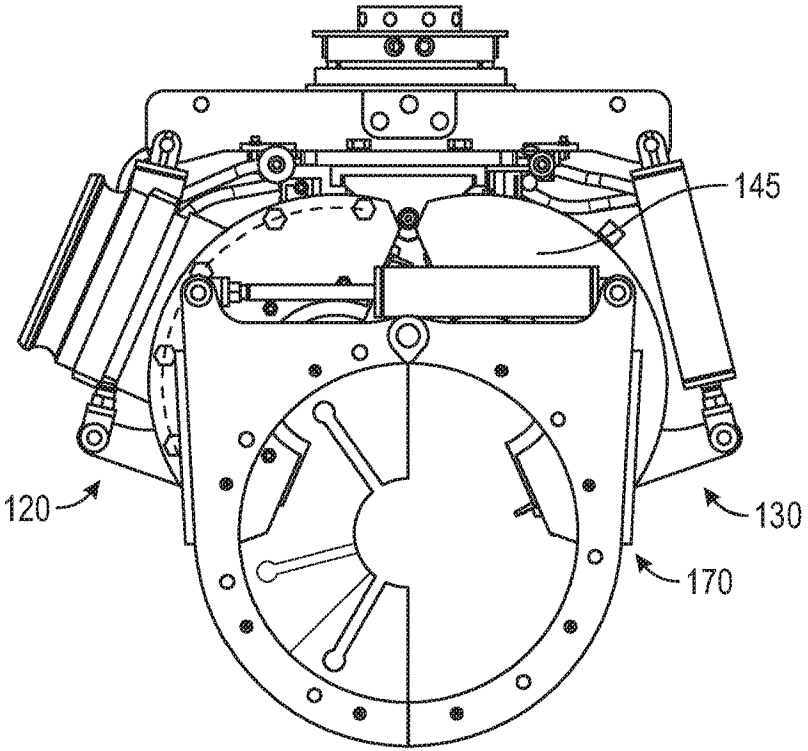
FIG. 11 illustrates a bottom view of the configurable mud bucket of FIG. 6 in an example.
Figure 10:
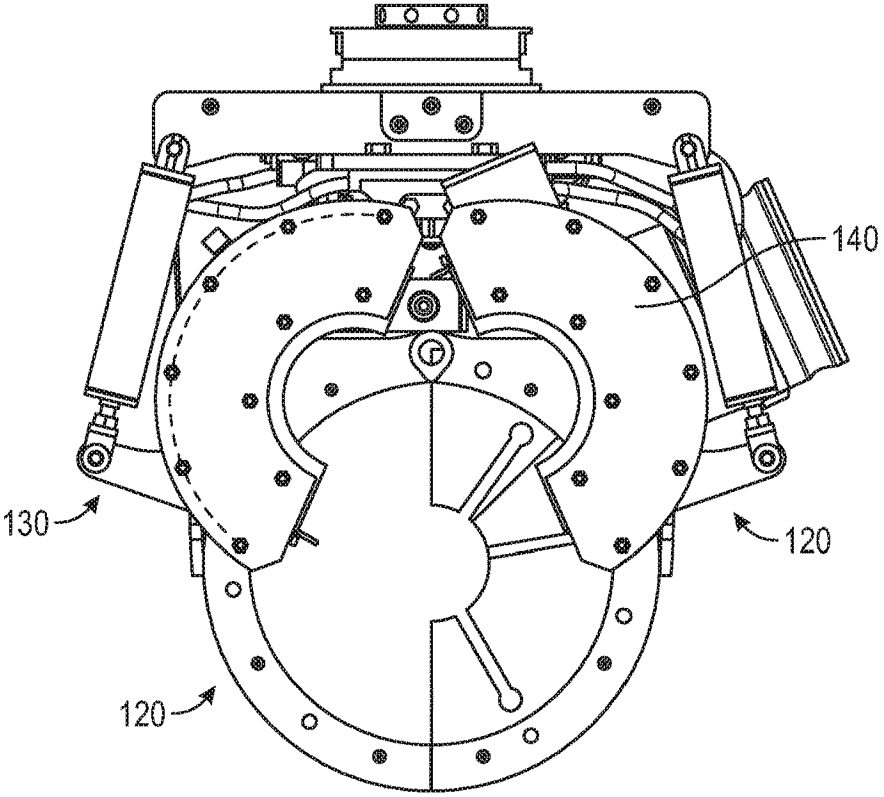
FIG. 10 illustrates a top view of the configurable mud bucket of FIG. 6 in an example.

FIG. 6 illustrates a perspective view of the configurable mud bucket 100 of FIG. 4 with a single outlet fluid diverter 165 and a pipe wiper 170, in an example. FIG. 7 illustrates a front view, FIG. 8 illustrates a side view, FIG. 9 illustrates a rear view, FIG. 10 illustrates a top view, and FIG. 11 illustrates a bottom view.

The single outlet fluid diverter 165 can be a diverter, similar to the dual outlet fluid diverter discussed above. The single outlet fluid diverter 165 can be attached and fluidly sealed to the mud bucket 100 at the bottom flange 145. The single outlet fluid diverter 165 can help divert mud away from the mud bucket 100 without deflecting the mud off the floor. In the case of a single outlet fluid diverter 165, only one outlet directs the captured mud away from the mud bucket 100.

The pipe wiper 170 can be attached to the mud bucket 100 through the single outlet fluid diverter 165. The single outlet fluid diverter 165 can include its own flange assembly including an attachment mechanism, such as a bolt hole pattern, and inner seal. The pipe wiper 170 can be fluidly coupled to the mud bucket 100 through the single outlet fluid diverter 165.

The pipe wiper 170 itself can be actuatable for wiping and cleaning pipe stickup, such as after the mud bucket 100 has been removed. In this case, the pipe wiper 170 below the mud bucket 100 can be deployed and pushed down the stickup to clean excess mud.

FIGS. 12-16 shows a perspective view of a bottom portion of a configurable mud bucket. The mud bucket may include a spray assembly providing the ability to spray the outside surface of the pipe string rather than wipe it, for example. However, both a wiper and a spray assembly may be provided. In one or more examples, the spray assembly may include one or more semi annular flange plates with a variety of holes or hole patterns allowing for selective placement of the spray heads.

Figure 12:
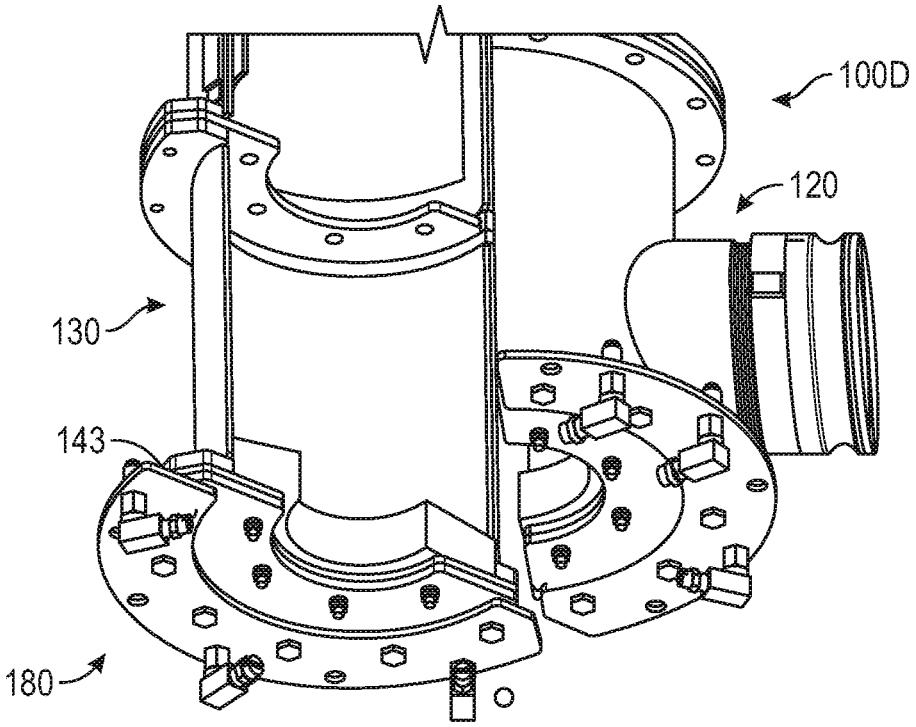
FIG. 12 illustrates a bottom perspective view of a configurable mud bucket having a spray assembly, in an example.
Figure 13:
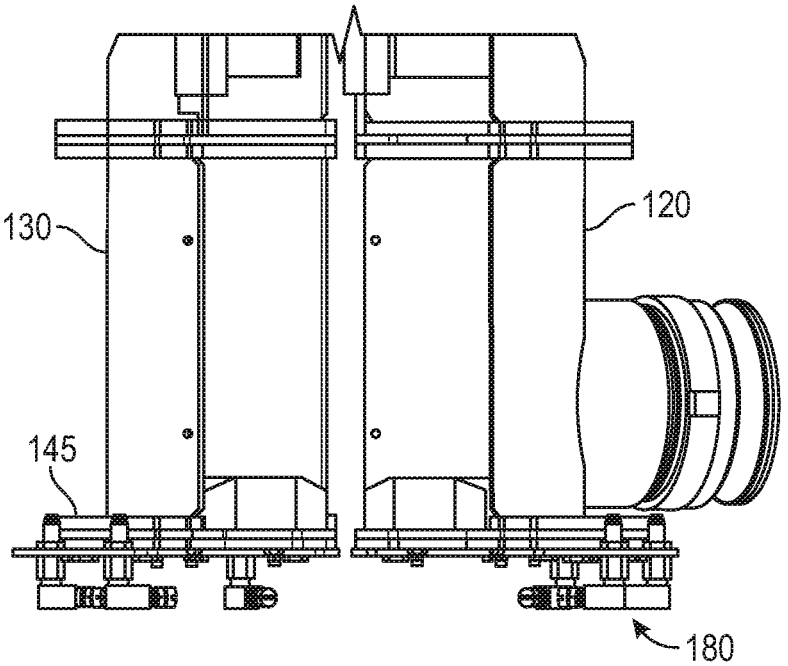
FIG. 13 illustrates a front view of the configurable mud bucket of FIG. 12 in an example.
Figure 14:
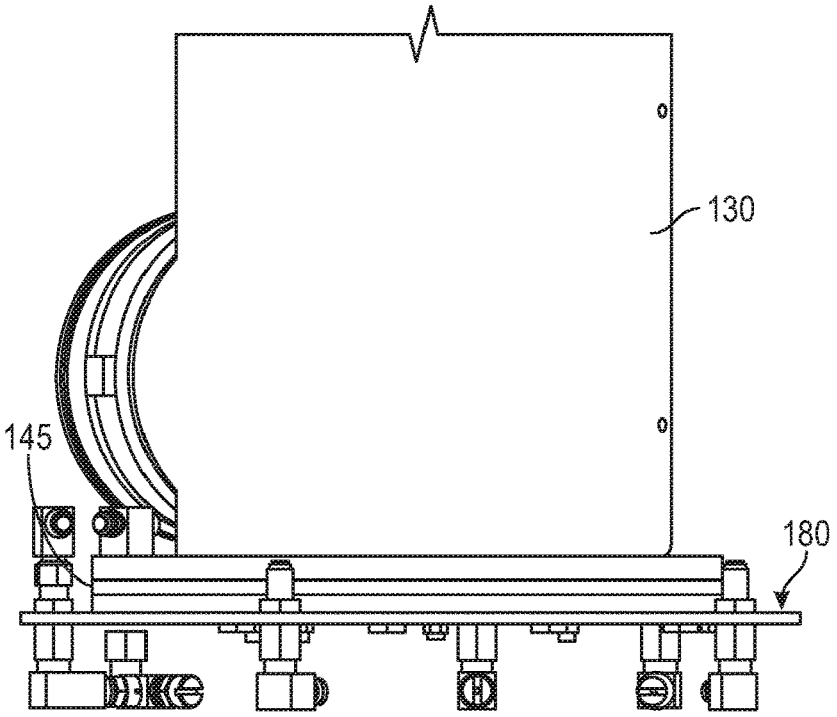
FIG. 14 illustrates a left side view of the configurable mud bucket of FIG. 12 in an example.
Figure 15:
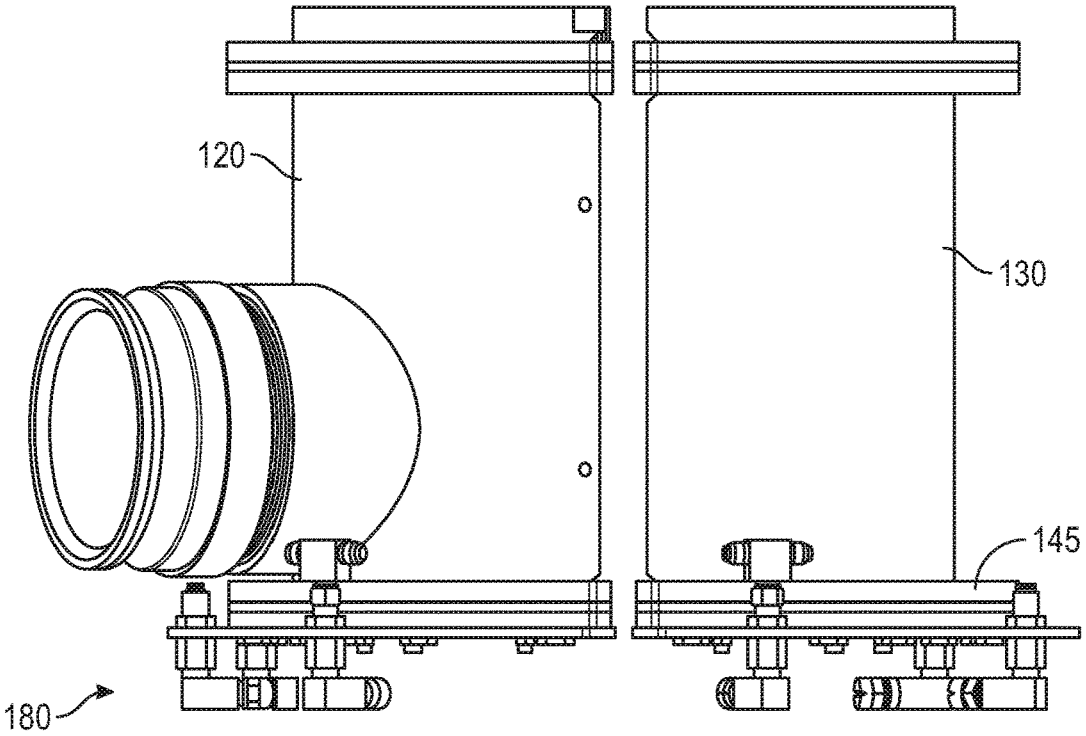
FIG. 15 illustrates a rear view of the configurable mud bucket of FIG. 12 in an example.
Figure 16:
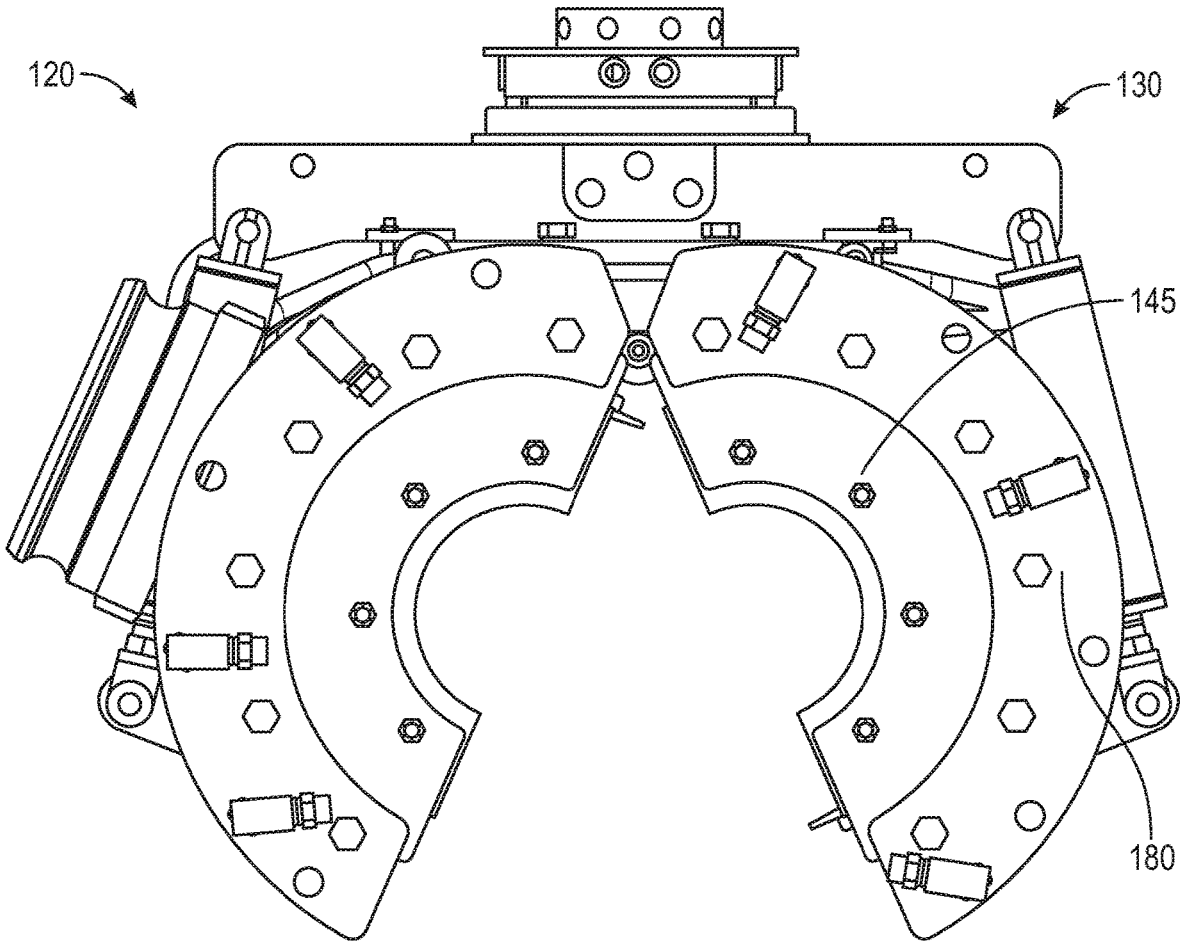
FIG. 16 illustrates a bottom view of the configurable mud bucket of FIG. 12 in an example.

FIG. 12 illustrates a bottom perspective view of a configurable mud bucket 100 having a spray assembly 180. FIG. 13 illustrates a front view, FIG. 14 illustrates a left side view, FIG. 15 illustrates a rear view, and FIG. 16 illustrates a bottom view of the configurable mud bucket.

The spray assembly 180 can be an accessory connected to the mud bucket 100 through the bottom flange 145. The spray assembly 180 can include a ring-like structure with a variety of nozzles, such as for spraying a pipe covered in mud. Often, pipes need to be cleaned while tripping out, such as prior to using the mud bucket. In this case, the nozzles of the spray assembly 180 can be deployed to spray water on the pipe and clear off water-based mud.

In one or more examples, the configurable mud bucket may include one or more sensors for determining or sensing whether there is fluid within the mud bucket. This may allow the mud bucket to open once the drilling mud has cleared the mud bucket without relying on inspection of the mud bucket by personnel or other systems.

In operation, the containment device described herein may be configured by the operator to accommodate the use condition. For example, upper and/or lower extensions may be attached to the mud bucket to accommodate the size of the tooling joint that is present on the drill pipe being used for drilling operations. In addition, a dual outlet or single outlet diverter may be provided on a bottom side of the mud bucket depending on whether the drill fluid that is being used is desired to be captured, recycled, and/or reused. For example, water-based drill fluids may often be discarded and if the operator chooses to discard the water-based drill fluid or other drill fluid, the operator may configure the mud bucket to have an open bottom without a seal. Where the drill fluid is desired to be captured, recycled, or reused, the operator may add a dual outlet or single outlet diverter to the mud bucket and secure the pipe of the diverter to a collection pipe, drain, or other conduit. Still further, depending on the desired type of pipe cleaning, the operator may include a wiper mechanism on the mud bucket or the operator may include a spray mechanism. In one or more examples, the operator may include both.

Various embodiments of the present disclosure may be described herein with reference to flowchart illustrations and/or block diagrams of methods, apparatus (systems), and computer program products. Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

VARIOUS NOTES & EXAMPLES

Example 1 is a configurable drill fluid containment device comprising: a central shell comprising: a first half shell having a first upper flange and a first lower flange; and a second half shell having a second upper flange and a second lower flange, wherein the first half and the second half together form a jacket configured to at least partially enclose an end of drill pipe; wherein first upper flange and the second upper flange together comprise an upper flange configured for attaching one or more extension features to the device at an upper end, and wherein the first lower flange and the second lower flange together comprises a lower flange configured for attaching one or more extension features to the device at a lower end.

In Example 2, the subject matter of Example 1 optionally includes wherein the jacket comprises an inner diameter larger than a tool end of a drill pipe.

In Example 3, the subject matter of any one or more of Examples 1-2 optionally include wherein the upper flange and the lower flange each comprise one or more attachment mechanisms for connection of extension features.

In Example 4, the subject matter of Example 3 optionally includes wherein the attachment mechanism comprises a bolt hole pattern adapted to receive an extension.

In Example 5, the subject matter of any one or more of Examples 3-4 optionally include wherein the attachment mechanism comprises a snap fit connection or a pneumatic airline connection.

In Example 6, the subject matter of any one or more of Examples 3-5 optionally include wherein the attachment mechanism is adapted to receive a configuration element for the device.

In Example 7, the subject matter of any one or more of Examples 1-6 optionally include a first seal adapter flange on the first half shell, and a second seal adapter flange of the second half shell.

In Example 8, the subject matter of Example 7 optionally includes two upper pipe seal halves, one situated on each of the first half shell and the second half shell.

In Example 9, the subject matter of Example 8 optionally includes wherein the first and second adapter flanges are adapted to receive a seal.

In Example 10, the subject matter of any one or more of Examples 8-9 optionally include the wherein the seal is situated circumferentially inward from an attachment mechanism.

In Example 11, the subject matter of any one or more of Examples 1-10 optionally include a frame configured to support the drill fluid containment device.

In Example 12, the subject matter of any one or more of Examples 1-11 optionally include one or more hydraulic cylinders actuatable for attaching one or more extension features to the drill fluid containment device.

In Example 13, the subject matter of any one or more of Examples 1-12 optionally include wherein the extension feature comprises a diverter assembly.

In Example 14, the subject matter of Example 13 optionally includes wherein the diverter assembly comprises a dual outlet diverter assembly.

In Example 15, the subject matter of any one or more of Examples 13-14 optionally include wherein the diverter assembly comprises a single outlet diverter assembly.

In Example 16, the subject matter of any one or more of Examples 1-15 optionally include wherein the extension feature comprises a wiper assembly.

In Example 17, the subject matter of any one or more of Examples 1-16 optionally include wherein the extension feature comprises a spray assembly.

In Example 18, the subject matter of any one or more of Examples 1-17 optionally include a sensor adapted to determine if fluid is within the shell portion or whether the shell is substantially empty.

Example 19 is a drill rig comprising: a support structure; a drill floor situated on the support structure; a mast extending upwards from the drill floor; a drill fluid containment device situated therein, the drill fluid containment device comprising: a central shell having a first half and a second half, the first half shell having a first upper flange and a first lower flange, and the second half shell having a second upper flange and a second lower flange, wherein the first half and the second half together form a jacket configured to at least partially enclose an end of drill pipe; wherein first upper flange and the second upper flange together comprise an upper attachment mechanism configured for connecting one or more extension features to the device at an upper end, and wherein the first lower flange and the second lower flange together comprises a lower attachment mechanism configured for connecting one or more extension features to the device at a lower end.

In Example 20, the subject matter of Example 19 optionally includes wherein each of the upper and lower attachment mechanisms comprise a bolt hole array, a snap fit connector, or a pneumatic fitting.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A configurable drill fluid containment device comprising:

a central shell comprising:

a first half shell having a first upper flange and a first lower flange; and a second half shell having a second upper flange and a second lower flange, wherein the first half and the second half together form a jacket configured to at least partially enclose an end of drill pipe;

wherein the first upper flange and the second upper flange together comprise an upper flange configured for attaching one or more extension features to the device at an upper end, wherein the first lower flange and the second lower flange together comprises a lower flange configured for attaching one or more extension features to the device at a lower end; and wherein the extension feature includes at least one of a fluid containment device extension, a diverter assembly with an outlet, a spray assembly, or a wiper assembly configured to move laterally relative to a longitudinal centerline of the drill fluid containment device.

2. The device of claim 1, wherein the jacket comprises an inner diameter larger than a tool end of a drill pipe.

3. The device of claim 1, wherein the upper flange and the lower flange each comprise one or more attachment mechanisms for connection of extension features.

4. The device of claim 3, wherein the attachment mechanism comprises a bolt hole pattern adapted to receive an extension.

5. The device of claim 3, wherein the attachment mechanism comprises a snap fit connection or a pneumatic airline connection.

6. The device of claim 3, wherein the attachment mechanism is adapted to receive a configuration element for the device.

7. The device of claim 1, further comprising a first seal adapter flange on the first half shell, and a second seal adapter flange of the second half shell.

8. The device of claim 7, further comprising two upper pipe seal halves, one situated on each of the first half shell and the second half shell.

9. The device of claim 8, wherein the first and second adapter flanges are adapted to receive a seal.

10. The device of claim 8, wherein the two upper pipe seal halves are situated circumferentially inward from an attachment mechanism.

11. The device of claim 1, further comprising a frame configured to support the drill fluid containment device.

12. The device of claim 1, wherein the extension feature comprises a diverter assembly.

13. The device of claim 12, wherein the diverter assembly comprises a dual outlet diverter assembly.

14. The device of claim 12, wherein the diverter assembly comprises a single outlet diverter assembly.

15. The device of claim 1, wherein the extension feature comprises a wiper assembly.

16. The device of claim 1, wherein the extension feature comprises a spray assembly.

17. The device of claim 1, further comprising a sensor adapted to determine if fluid is within the central shell, or whether the shell is substantially empty.

18. A drill rig comprising:

a support structure;

a drill floor situated on the support structure;

a mast extending upwards from the drill floor;

a drill fluid containment device situated therein, the drill fluid containment device comprising:

a central shell having a first half and a second half, the first half shell having a first upper flange and a first lower flange, and the second half shell having a second upper flange and a second lower flange, wherein the first half and the second half together form a jacket configured to at least partially enclose an end of drill pipe;

wherein the first upper flange and the second upper flange together comprise an upper attachment mechanism configured for connecting one or more extension features to the device at an upper end, wherein the first lower flange and the second lower flange together comprises a lower attachment mechanism configured for connecting one or more extension features to the device at a lower end; and wherein the extension feature includes at least one of a fluid containment device extension, a diverter assembly with an outlet, a spray assembly, or a wiper assembly configured to move laterally relative to a longitudinal centerline of the drill fluid containment device.

19. The drill rig of claim 18, wherein each of the upper and lower attachment mechanisms comprise a bolt hole array, a snap fit connector, or a pneumatic fitting.

20. A configurable drill fluid containment device comprising:

a central shell comprising:

a first half shell having a first upper flange and a first lower flange; and a second half shell having a second upper flange and a second lower flange;

wherein the first half and the second half together form a jacket configured to at least partially enclose an end of drill pipe;

wherein the first upper flange and the second upper flange together comprise an upper flange configured for attaching one or more extension features to the device at an upper end;

wherein the first lower flange and the second lower flange together comprises a lower flange configured for attaching one or more extension features to the device at a lower end; and one or more hydraulic cylinders actuatable for attaching one or more extension features to the drill fluid containment device.

* * * * *